United States Patent [19]

Landreth

[11] Patent Number: 4,934,001

[45] Date of Patent: Jun. 19, 1990

[54] PORTABLE SHOWER/SPRAY APPARATUS

[76] Inventor: Ronnie L. Landreth, 1829 Ave. B, Grand Prairie, Tex. 75050

[21] Appl. No.: 337,830

[22] Filed: Apr. 14, 1989

[51] Int. Cl.[5] ..... A47K 3/22

[52] U.S. Cl. ..... 4/615

[58] Field of Search ..... 4/615–617, 4/601–603, 607–610, 597–600; 239/273, 282, 283

[56] References Cited

U.S. PATENT DOCUMENTS

| | | | |
|---|---|---|---|
| 590,780 | 9/1897 | Travis | 239/273 |
| 1,330,312 | 2/1920 | Figueroa | 4/599 |
| 1,398,208 | 11/1921 | Trail | 4/617 |
| 1,671,006 | 5/1928 | Bartlett | 248/317 |
| 1,962,793 | 6/1934 | Vogel | 4/615 X |
| 2,073,307 | 3/1937 | Isenberg | 4/615 X |
| 2,121,985 | 6/1938 | Robertson | 4/617 |
| 2,403,430 | 7/1946 | Andrews et al. | 4/617 |
| 3,208,083 | 9/1965 | Witczak | 4/615 X |
| 4,280,643 | 7/1981 | Cordova et al. | 4/617 X |
| 4,561,136 | 12/1985 | Baer | 4/615 |
| 4,720,878 | 1/1988 | Viner | 4/615 |

FOREIGN PATENT DOCUMENTS

| | | | |
|---|---|---|---|
| 954255 | 12/1949 | France | 4/602 |
| 965590 | 9/1950 | France | 4/608 |
| 273337 | 5/1951 | Switzerland | 4/615 |
| 328354 | 4/1958 | Switzerland | 4/615 |

*Primary Examiner*—Charles E. Phillips

*Attorney, Agent, or Firm*—Charles W. McHugh

[57] ABSTRACT

In brief, the invention includes a portable shower and spray apparatus which is adapted to selectively direct a jet of water in a desired direction. The apparatus includes a generally planar base which is adapted to be placed directly on the ground or suspended from an elevated anchoring point. Attached to one side of the base is a housing which is sized and positioned so as to enclose a portion of a water conduit. The conduit has a terminal end which may conveniently be connected to a water hose of the type commonly used to water a yard or a garden; the conduit also has a functional end with a shower head attached thereto. Mounted at an intermediate location of the water conduit is a control valve for regulating the amount of water which exits the shower head. The preferred planar base covers an area of nearly 170 square inches, which makes the apparatus very stable when it is resting directly on the ground, and it is not easily tipped over. Attached near one end of the base is a means for selectively suspending the apparatus from an elevated anchoring point. The suspension means preferably constitutes a flexible rope having two ends. To ensure that the rope does not become separated from the base (and lost), at least one end of the rope is permanently connected to one side of the portable base, the second end of the rope may then be removably connected to the opposite side of the base. By using a flexible rope as the suspension means, the base may be attached to any of a variety of elevated anchoring points.

2 Claims, 2 Drawing Sheets

PORTABLE SHOWER/SPRAY APPARATUS

BACKGROUND OF THE INVENTION

This invention relates generally to a portable shower and spray apparatus; more specifically it relates to a shower and spray apparatus having a configuration so that it may be suspended vertically from an elevated anchoring point or placed horizontally directly upon the ground.

It is well known to use a conventional shower apparatus in a bathroom to direct a stream of water over a person's body for cleaning, rinsing, etc. There are many occasions, however, when it would be desirable to use a similar apparatus outside a residence, to wash or cool-off a person's body. And at least one U.S. Pat. No. (3,925,830 entitled "Foot Shower and Spray Device") discloses an apparatus specially constructed to be positioned next to a swimming pool so that a swimmer's feet may be washed off before entering the pool. This apparatus presumably would function admirably to direct a spray of water in a generally horizontal direction; however, it would be awkward and cumbersome to try to elevate the apparatus so that it might direct a shower of water downwardly over the body of a person or pet. Also, because this apparatus is particularly adapted to be used in a fixed position next to a pool, it would not be handy to pick up and carry somewhere else.

Of course, there have been some prior art devices which have been described as "portable" but which in fact are not necessarily the kinds of things one would like to drag around the backyard. One such device is constructed such that it may be unfolded from a box-like compartment and assembled into a free-standing shower system. An example of this type of shower device is shown in U.S. Pat. No. 4,413,363 to Troiano entitled "Portable Shower System."

A bona fide portable device having a shower head is shown in U.S. Pat. No. 3,982,284 to Becker entitled "Portable Wash Stand." The base of this device includes three slender legs forming a tripod which supports a wash stand in a vertical mode. The device has some useful appendages for supporting toiletries, towels, etc.; but if this device was accidentally bumped, it would tend to easily tip over because of its high center of gravity. Also, the device is probably very handy—as a wash stand; but by trying to be so versatile and do so many things, it may begin to lose its efficiency at doing any one thing extremely well. That is, the device is really too short to be a perfect shower—at least for an adult, and it is too tall to be a perfect foot bath. And it is not adapted to lay on its side for directing a spray of water at "foot" or "dog" level.

Most of the above-described body shower or foot spray devices have been uniquely constructed so as to direct a spray or shower of water in a single direction, either upwardly, downwardly or horizontally. But the designers of these prior art shower devices seem to have disregarded the possibility that a shower might need to direct a stream of water in more than one major direction. Therefore, there has remained a need for a truly portable shower/spray apparatus which is adapted to project a spray of water equally well in any of a variety of directions, depending upon the orientation and location of an inherently stable base. It is an object of this invention to provide such a portable and versatile shower/spray apparatus.

Another object is to provide a stable shower/spray apparatus having a low center of gravity so as to prevent the apparatus from being easily tipped over when it is resting directly upon the ground.

One more object is to provide a portable apparatus having a flexible suspension rope adapted to be easily wrapped over a tree limb or hooked to an elevated anchoring spot.

Still another object is to provide a shower apparatus having a base and housing constructed of a durable wood-like material to prevent rotting or deterioration when the base is left outside on wet ground, exposed to inclement weather, or used in a salt water environment, etc.

These and other objects will no doubt be apparent from a reading of the specification and claims, and from a study of the accompanying drawing illustrating certain embodiments of the invention.

BRIEF DESCRIPTION OF THE INVENTION

Figure 1:
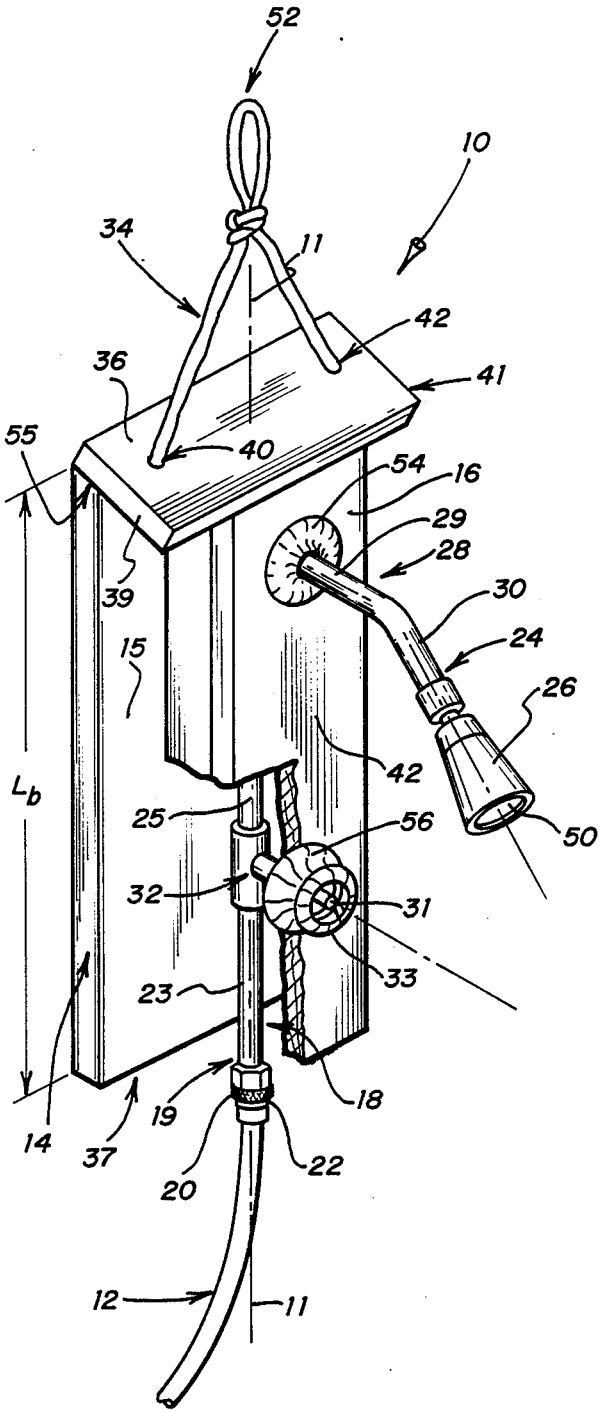
FIG. 1 is a perspective view of one embodiment of the invention showing a shower/spray apparatus having a base and housing, with a shower head and water control knob positioned at the front of the housing, and showing a portion of the housing broken away so as to illustrate a water conduit and control valve connection, as well as a water conduit and hose supply connection.

In brief, the invention includes a portable shower and spray apparatus which is adapted to selectively direct a jet of water in a desired direction. The apparatus includes a generally planar base which is adapted to be placed directly on the ground or suspended from an elevated anchoring point. Attached to one side of the base is a housing which is sized and positioned so as to enclose a portion of a water conduit. The conduit has a terminal end which may conveniently be connected to a water hose of the type commonly used to water a yard or a garden; the conduit also has a functional end with a shower head attached thereto. Mounted at an intermediate location of the water conduit is a control valve for regulating the amount of water which exits the shower head. Once water is supplied to the apparatus through the hose connection, the apparatus may be advantageously used before entering a swimming pool for rinsing off grass-clippings or other debris which might be on a person's feet. For such a use, the apparatus will usually be oriented so that its base is substantially horizontal. The preferred planar base covers an area of nearly 170 square inches, which makes the apparatus very stble when it is resting directly on the ground, and it is not easily tipped over. Another feature contributing to the stability of the apparatus (when it is in a horizontal mode) is its low center of gravity—which is preferably located no more than about 1½ or 2 inches above the base.

Attached near one end of the base is a means for selectively suspending the apparatus from an elevated anchoring point. The suspension means preferably constitutes a flexible rope having two ends. To ensure that the rope does not become separated from the base (and lost), at least one end of the rope is permanently connected to one side of the portable base; the second end of the rope may then be removably connected to the opposite side of the base. By using a flexible rope as the suspension means, the base may be attached to any of a variety of elevated anchoring points. For example, the shower apparatus could be attached to a tree limb in a person's backyard for bathing a dog or giving neighborhood kids a shower before they climb into a private pool. It could also be attached through a conventional water hose to a water faucet at a recreational vehicle park—for taking a quick shower to cool off or to freshen up after a strenuous day. Or, it could be attached to an elevated hook or nail on a beachhouse deck for rinsing off salt water.

The preferred embodiment of the invention is heavy enough to foster stability when the base is lying on the ground; but it is also sufficiently light as to be easily carried and lifted by a person to an elevated anchoring point, such as a tree lim, fence post, etc. The ideal weight of such a shower/spray apparatus will usually be less than 6 pounds. To foster handling and storage of the apparatus, the base and housing are compactly built, preferably occupying a space of no more than 510 cubic inches, thereby making the base and housing small enough to fit into a typical clothes closet or recreational vehicle storage compartment.

DETAILED DESCRIPTION OF A PREFERRED EMBODIMENT OF THE INVENTION

Referring initially to FIG. 1, a portable shower and spray apparatus 10 is shown connected to a conventional water hose 12. The apparatus 10—shown in a vertical mode—preferably has a generally elongated shape, with a centerline 11 extending in a longitudinal direction. The apparatus 10 includes an elongated base 14 which is configured so that it may rest in a stable horizontal mode directly upon the ground, and it has a generally planar area which preferably encompasses an area of about 170 square inches. The shape of the illustrated base 14 is generally rectangular, with its width preferably being less than ½ of its length (which is represented by the notation $L_b$ in FIG. 1); however, the shape of the base is not critical, and it may be square, circular, eliptical, etc. In a particularly useful embodiment, the length $L_b$ is about 22 inches, and the width is about 7½ inches. When the apparatus 10 is in its horizontal mode, the substantially flat, skid-like construction of the base 14 promotes stability and prevents the apparatus from being easily tipped over. The base 14 is preferably made from wood or a durable wood-like material having characteristics so that the apparatus 10 may be left outdoors in wet weather conditions or exposed to a salt water environment, etc. A readily available material which could be used to make the base 14 is a board of 1×8 inch pine, cedar or redwood.

Mounted on the base front surface 15 is a water conduit 18. One end of the conduit 18 has a hose connector 20 adapted to be engaged with the terminal end 22 of a water hose 12; the second end 24 of the conduit preferably has a shower head 26 affixed thereto. The conduit 18 is conveniently assembled from three segments of water pipe constituting a connector pipe 23, an intermediate pipe 25 and a discharge pipe 28. The connector and intermediate pipes 23, 25 are joined by a control valve 32; the hose connector 20 is attached to the terminus 19 of the connector pipe 23. Both straight pipes 23, 25 have a longitudinal central axis that is approximately parallel to the planar base 14 and generally coincident with the apparatus centerline 11. The discharge pipe 28 is connected to the distal end (not seen) of the intermediate pipe 25 by a conventional pipe elbow. When so connected, the inner region 29 of the discharge pipe extends outwardly away from the base 14 and generally perpendicular thereto. An optional housing 16 (to be described) may be mounted adjacent the base to enclose the connector and intermediate pipes 23, 25 and at least a portion of the discharge pipe 28 (or pipe extension).

Figure 2:
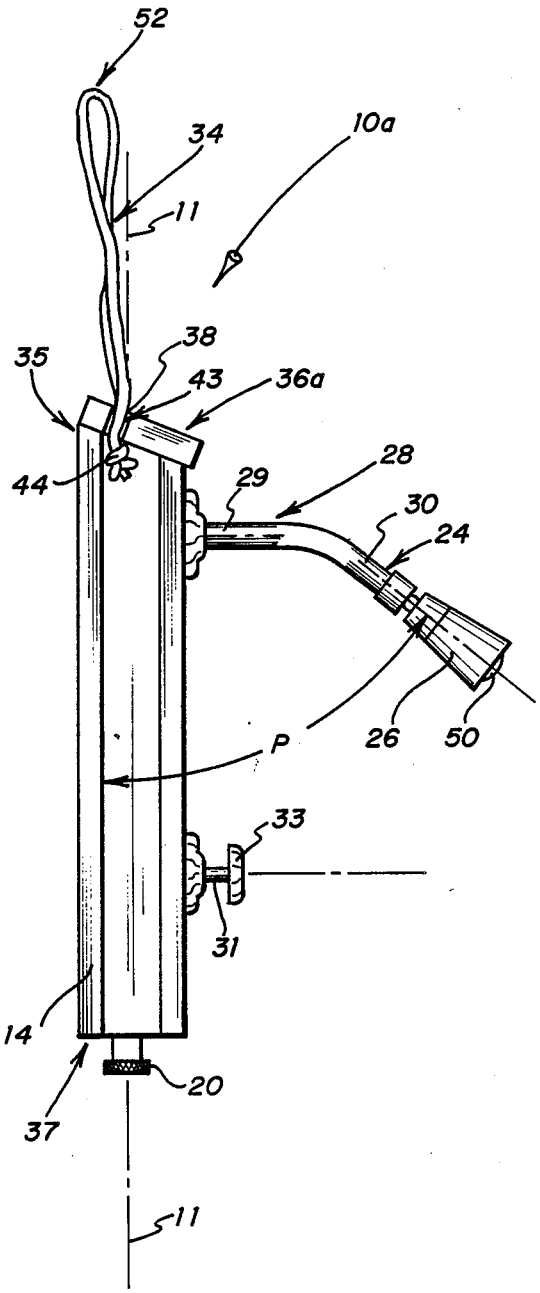
FIG. 2 is an elevational side view of another embodiment of the invention showing a profile of the planar base, with a roof affixed to one end of the base, and showing a flexible rope having a knot at one end, with the rope immediately above the knot being snugly inserted into a slot in the roof.

Turning next to FIG. 2, it will be clearly seen that the outer region 30 of the pipe extension 28 makes an angle of about sixty degrees with respect to the base 14; this angle is represented in the drawing by the notation P. Attached to the pipe terminus 24 is the shower head 26, which is preferably pivotable so that it may be pointed at least somewhat away from the axis of pipe outer region 30—either upwardly, downwardly or sideways. Of course, the orientation of the curved pipe 28 already assists in guiding a shower of water downwardly when the apparatus 10 is in its vertical mode. An adjustment means 50 at the distal end of the shower head 26 may be used to vary the size and velocity of the water droplets that are discharged. The pipe extension 28 is preferably formed from a conventional ½ inch water pipe having an OD of about ⅞ inch. The exterior surface of the pipe 28 is ideally plated so that it has an aesthetically pleasing appearance, and so that it may be easily cleaned. In this particular embodiment, the length of the curved pipe 28 is nearly eight inches, with about six inches of the pipe extending outwardly beyond the face of the optional housing 16.

Referring again to FIG. 1, the control valve 32 (e.g., a plug-type globe valve) is mounted at an intermediate location of the conduit 18. Of course, the function of the control valve 32 is to control the amount of water that is permitted to pass through the conduit 18 for eventual discharge through the shower head 26; and any valve which will serve this purpose should be quite adequate. The illustrated control valve 32 has a stem 31 which projects (in a perpendicular direction) away from the face 15 of the base 14; when an optional housing 16 is attached to the base, the stem will extend about one inch beyond the face 42 of the housing. Affixed to the distal end of the stem 31 is a rotatable control knob 33 for manually operating the control valve 32 so as to regulate water flow through the conduit 18. Naturally the control knob 33 is sized and configured as to be easily manipulated by a couple of digits of a person's hand.

Once the convenient conduit-to-hose connection 20/22 has been made and pressurized water is supplied to the apparatus 10 (e.g., by turning on a remote water faucet connected to the proximate end of hose 12), the shower apparatus 10 may be turned on at will. In order to facilitate operation of the apparatus 10 by adults and children—when the apparatus is in its vertical mode, the shower head 26 is located adjacent the upper end 35 of the elongated base 14, while the control valve 32 is mounted near the lower end 37 of the base. By placing the control knob 33 below the shower head 26, the knob is more readily accessible to small children.

Affixed to the base surface 15 is a generally elongated housing 16 which is configured to form a tube-like cavity which envelopes at least a major portion of the water conduit 18. The housing 16 preferably has a length which is about the same as the length of the base 14; also, the housing may advantageously be constructed from the same material as the base. The housing 16 serves to protect the conduit 18 from being easily snagged and bent or twisted sideways; and the housing also serves as a cosmetic cover to conceal the conduit pipes 23, 25 and pipe connections. To complete the cosmetic design, a first collar 54 is mounted at the base of pipe 28, and a second collar 56 is mounted at the base of control valve stem 31.

Affixed near one end of the elongated base 14 is a means for selectively suspending the base from an elevated anchoring point. A flexible rope 34 is preferably employed as the suspension means so that a loop 52 may be created and securely wrapped over an elevated anchoring structure such as a fence post, nail, hook, etc. The rope 34 is preferably about three feet long, and it should not be susceptible to rotting or deterioration when left outside on wet ground, exposed to inclement weather, or used in a salt water environment, etc. Nylon rope about $\frac{1}{4}$ inch in diameter is a suitable material, and it is readily available at most hardware or building supply stores.

In the embodiment shown in FIG. 1, an optional roof 36 is employed to affix the flexible rope 34 to one end of the base 14. The slanted roof 36 has two apertures 40, 42, with one aperture being disposed near each of the two sides 39, 41. Each of the apertures 40, 42 has a diameter which is slightly larger than the flexible rope 34, such that the aperture may slidably receive respective ends of rope. The two rope ends are captured under the roof by knots tied at each rope end, so as to prevent the rope 34 from becoming separated from the base 14 (and perhaps being lost).

Figure 3:
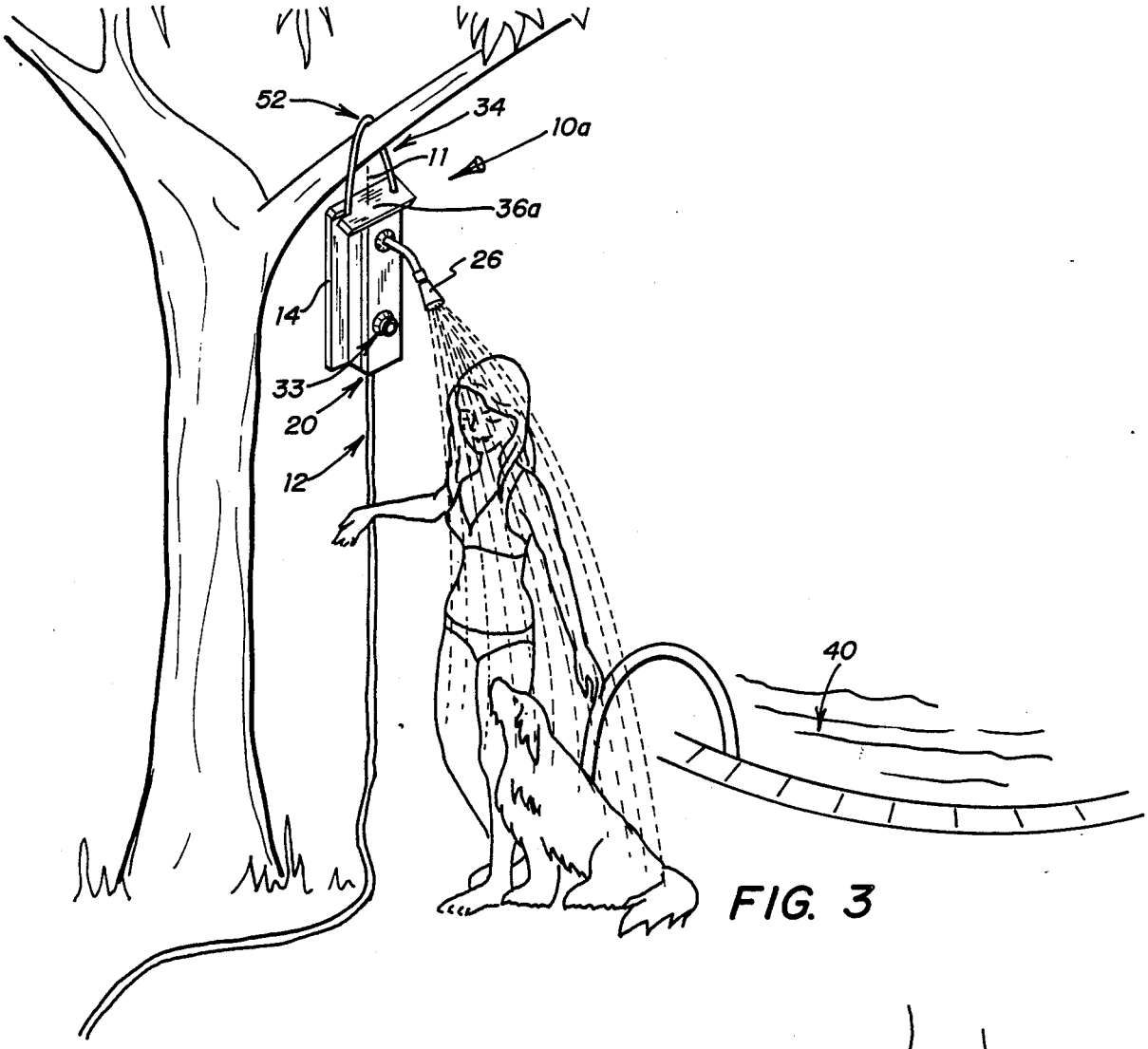
FIG. 3 is a perspective view of the apparatus in its vertical mode—showing the apparatus suspended from a tree, with the apparatus oriented so as to direct shower of water downwardly over a person and a dog.

Referring again to FIG. 2, a variation of the roof is illustrated, showing a slanted roof **36*a* with a slot 38 which extends outwardly through to the left side of the roof. The slot 38 is sized and configured to selectively capture the rope 34 immediately above a knot 44 tied at the left end 43 of the rope. The knot 44 is positioned so as to prevent the rope 34 form being pulled out of roof slot 38 in a generally longitudinal direction with respect to the apparatus centerline 11. The knot 44 may be moved toward the entrance of slot 38 so as to free the rope end 43. With such a construction, the base 14 may be conveniently attached to any of a variety of elevated anchoring points (e.g., tree limb, fence post, etc.) in order that a user might install the apparatus 10*a* at a desired location that is within reach of a water hose 12. After water is supplied to the shower apparatus, a user may turn on the apparatus with control knob 33 to enjoy a shower of downwardly directed water as shown in FIG. 3**.

The apparatus is constructed so that the hose connector 20 is affixed at one end of the base 14, and the flexible rope 34 is affixed to the other end. The hose connector 20 is oriented such that the water conduit 18 will be directly in line with a water hose 12 when it is connected to the apparatus **10*a*. As clearly seen in FIG. 3, the apparatus 10*a* is ideally suspended such that a substantial portion of hose 12 hangs below the apparatus. The weight of the hose 12 tends to pull down on the apparatus and stabilize it so as to prevent it from swinging. By virtue of the orientation of the conduit-to-hose connection and the weight of the apparatus 10*a*, it will generally remain in a substantially vertical mode even when a forceful jet of water is supplied through the hose 12** or a gust of wind blows against the apparatus.

Figure 4:
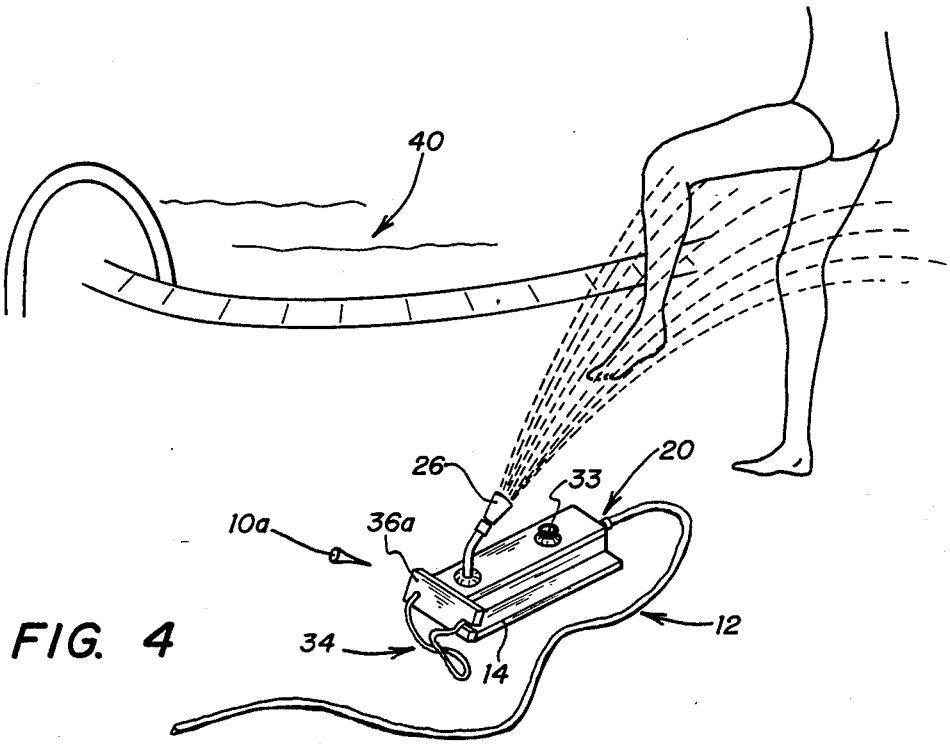
FIG. 4 is a perspective view of the apparatus in its horizontal mode—showing the apparatus placed directly on the ground so as to orient a spray of water upwardly where it would be effective to wash off a person's leg and foot.

Turning next to FIG. 4, it should be recognized that a major advantage of using a flexible rope for the suspension means is that is unobtrusive and easily folds out of the way when the apparatus base 14 is moved from its vertical mode to a horizontal mode. The base 14 of the apparatus **10*a* may quickly and conveniently be moved from its suspended orientation and alternatively placed on the ground, so that water may be directed upwardly by the shower head 26. One feature that contributes to the stability of the apparatus when it is resting directly on the ground is its very low center of gravity—which is preferably located about $1\frac{1}{2}$ inches above the base 14. This feature tends to keep the apparatus from tipping over if it is moved on the ground or accidently bumped. Keeping the low center of gravity of the apparatus 10 (or 10*a*) in mind, it will be appreciated that the smooth underside of the base 14 permits the apparatus to be easily moved like a sled over the ground and oriented so as to direct a spray of water in a desired location. With this construction, the apparatus may conveniently be moved and oriented—with a person's foot—for washing off dirt, grass-clippings and other debris before entering a swimming pool 40**.

The apparatus 10 (or **10*a*) may be advantageously fabricated using materials found in most building supply stores, thereby minimizing the need for any custom-built parts. The preferred apparatus 10 includes five wooden members (used for the base 14, housing 16 and roof 36), three segments of water pipe 23, 25, 28, plumbing fixtures (including a hose connector 20, control valve 32, ninety-degree pipe elbow and shower head 26) and a flexible rope 34**.

In use, the shower and spray apparatus may be employed in one mode as a sprinkler for children who are playing outide on a warm summer day or as a swimming pool accessory. As shown in FIG. 4, the apparatus **10*a* may be connected to a water hose 12 and used near a swimming pool 40 to permit a person to wash off his/her legs and feet before entering the pool. Because of its true portability, the apparatus 10*a* could also be used in outdoor places other than a person's backyard. It could be connected to a water faucet at an recreational vehicle park or beachhouse—through a conventional water hose, so that a person could take a refreshing shower at the end of a busy day or wash off salt water or sand after playing on a beach. And to make washing a pet (e.g., a dog, cat, etc.) easier, the apparatus 10*a*** may be hung from an elevated anchoring spot, so that the user would have both hands free to wash and restrain the pet while it is being showered.

The apparatus **10*a* may conveniently be attached to a tree limb (as shown in FIG. 3) by removing rope end 43 from slot 38 and wrapping that end over the tree limb. The rope end 43 is snugly reinserted into slot 38, with the knot 44 captured below the roof 36*a*; in this way the apparatus 10*a* may be securely suspended from the limb without the use of nails or the like. A user may then easily connect a water hose 12 by grasping the hose terminal end 22 and lifting it so that it may be screwed into hose connector 20. Water is supplied to the apparatus 10***a* by turning on a remote water faucet connected to the hose 12. When control valve 32 is opened (by turning knob 33 in a counterclockwise direction), a downwardly directed shower of water will be discharged through the shower head 26.

When the apparatus 10*a* is placed on the ground, the flexible rope may easily be moved out of the way, so that the planar area of the base is immediately juxtaposed with the ground. Once the apparatus 10*a* is turned on, a spray of water may be directed upwardly under and around a person's foot, as shown in FIG. 4. If it is desirable to move the apparatus 10*a* to another location in a yard, the rope 34 may be used to pull the sled-like base of the apparatus or it may be pushed with a person's foot to the desired location.

In review, it may be said that the shower/spray apparatus described herein provides the best of all possible features of shower and spray devices, in that it may be hung from an elevated anchoring point or laid flat on the ground without having to reconfigure any structure. Having no cumbersome attachments or stands, the apparatus 10 may be quickly repositioned and oriented to conveniently direct a stream of water in a variety of directions. The apparatus 10 is truly portable and it is light enough as to be easily carried and lifted by children and adults to an elevated anchoring spot. However, it is also sufficiently heavy as to foster stability and prevent the apparatus from being easily knocked over—when it is lying flat on the ground. The ideal weight of such an apparatus is about 5½ pounds. Also, the base 14 and housing 16 are compactly constructed to enhance portability, with the base and housing preferably occupying a space of only about 495 cubic inches. Thus, the apparatus 10 would generally be small enough to fit into a recreational vehicle storage compartment or a car trunk.

While only certain preferred embodiments of the invention have been disclosed in detail herein, it should be apparent to those skilled in the art that modifications can be made without departing from the spirit of the invention. For example, the base and housing of the apparatus may be made longer, so that when the apparatus is suspended from an elevated anchoring spot, the control knob might be easier for a small child to reach when standing under the apparatus. Conversely, the apparatus may be made shorter such that the control valve knob is positioned immediately next to the shower head, thereby making the apparatus more compact; with such a construction, the apparatus could be conveniently carried or suspended so as to water flowers or other plants which may be on a patio or in a garden. Thus, any specific structure shown herein is intended to be exemplary and is not meant to be limiting, except as described in the claims appended hereto.

What is claimed is:

1. A portable shower apparatus comprising:

(a) a portable base having a top, a bottom, and first and second ends, and having a relatively thin profile, and having a bottom surface defining a generally planar support area that is configured so that it may rest in a stable mode directly upon the ground, such that the shower apparatus may rest horizontally on the ground and conveniently direct a spray of water upwardly at a person's lower extremities;

(b) a water conduit mounted on the base, with one end of said conduit having a hose connector adapted to be engaged with the terminal end of a water hose, and the other end of the conduit having a shower head thereon, and the shower head being positionable so that it forms an acute angle with respect to the base;

(c) a control valve associated with the water conduit and being positioned between the hose connector and the shower head in order to be serviceable for controlling the amount of water that is permitted to pass through the water conduit for eventual discharge from the shower head;

(d) means for selectively suspending the base in a generally vertical manner from an elevated anchoring point, such that the base may be attached to any of a variety of elevated anchoring points that are within reach of a water hose, whereby a user may enjoy a shower of downwardly directed water when the base is elevated and oriented vertically, with the amount of discharged water being controllable by manipulation of the control valve, whereby the user may selectively suspend the base vertically and enjoy a shower of downwardly directed water, or alternatively place the base horizontally on the ground and obtain a spray of upwardly directed water; and (e) a structural housing associated with the top of the base, and the housing being configured so as to conceal at least a substantial part of the water conduit, and the control valve protruding outwardly from the front of the housing so as to be conveniently accessible, and wherein the structural housing has a first end and a second end, and the first end is elevated above the second end when the base is operatively oriented in its vertical mode, and further including a structural cap attached to the first end of the housing, and said cap being sized and oriented so as to serve as a roof for the apparatus when it is oriented vertically.

2. A portable shower apparatus comprising:

(a) a portable base having a top, a bottom, and first and second ends, and having a relatively thin profile, and having a bottom surface defining a generally planar support area that is configured so that it may rest in a stable mode directly upon the ground, such that the shower apparatus may rest horizontally on the ground and conveniently direct a spray of water upwardly at a person's lower extremities;

(b) a water conduit mounted on the base, with one end of said conduit having a hose connector adapted to be engaged with the terminal end of a water hose, and the other end of the conduit having a shower head thereon, and the shower head being positionable so that it forms an acute angle with respect to the base;

(c) a control valve associated with the water conduit and being positioned between the hose connector and the shower head in order to be serviceable for controlling the amount of water that is permitted to pass through the water conduit for eventual discharge from the shower head;

(d) means for selectively suspending the base in a generally vertical manner from an elevated anchoring point, such that the base may be attached to any of a variety of elevated anchoring points that are within reach of a water hose, whereby a user may enjoy a shower of downwardly directed water when the base is elevated and oriented vertically, with the amount of discharged water being controllable by manipulation of the control valve, whereby the user may selectively suspend the base vertically and enjoy a shower of downwardly directed water, or alternatively place the base horizontally on the ground and obtain a spray of upwardly directed water; and (e) a structural housing associated with the top of the base, and the housing being configured so as to conceal at least a substantial part of the water conduit, and the control valve protruding outwardly from the front of the housing so as to be conveniently accessible, and wherein both the base and the housing are constructed of material selected from the class of materials that include wood and wood-like products.

* * * * *